US010688807B2

(12) United States Patent
Yamauchi et al.

(10) Patent No.: US 10,688,807 B2
(45) Date of Patent: Jun. 23, 2020

(54) THERMAL PRINT HEAD AND THERMAL PRINTER

(71) Applicant: TOSHIBA HOKUTO ELECTRONICS CORPORATION, Asahikawa-shi (JP)

(72) Inventors: Megumi Yamauchi, Asahikawa (JP); Seiichi Noro, Asahikawa (JP); Masakatsu Doi, Asahikawa (JP); Yoshihide Abe, Asahikawa (JP); Tomonori Suzuki, Asahikawa (JP); Yuuki Komori, Asahikawa (JP); Tsuyoshi Yamamoto, Asahikawa (JP)

(73) Assignee: Toshiba Hokuto Electronics Corporation, Asahikawa-Shi (JP)

( * ) Notice: Subject to any disclaimer, the term of this patent is extended or adjusted under 35 U.S.C. 154(b) by 0 days.

(21) Appl. No.: 16/213,138

(22) Filed: Dec. 7, 2018

(65) Prior Publication Data

US 2019/0193418 A1 Jun. 27, 2019

(30) Foreign Application Priority Data

Dec. 25, 2017 (JP) ..... 2017-247710

(51) Int. Cl.
*B41J 2/355* (2006.01)
*B41J 2/335* (2006.01)

(52) U.S. Cl.
CPC ..... *B41J 2/355* (2013.01); *B41J 2/3351* (2013.01); *B41J 2/3353* (2013.01); *B41J 2/3354* (2013.01); *B41J 2/3355* (2013.01); *B41J 2/3357* (2013.01); *B41J 2/33515* (2013.01); *B41J 2/33525* (2013.01)

(58) Field of Classification Search
CPC ..... B41J 2/355; B41J 2/3355; B41J 2/3353; B41J 2/3354; B41J 2/3357; B41J 2/33525; B41J 2/33515; B41J 2/3351; B41J 2/35; B41J 2/3553; B41J 2/3555; B41J 2/3556; B41J 2/3558; B41J 2/135; B41J 2/335
See application file for complete search history.

(56) References Cited

U.S. PATENT DOCUMENTS 8,742,258 B2 6/2014 Terashima et al.
2007/0235887 A1 10/2007 Kaimori et al.

FOREIGN PATENT DOCUMENTS

JP 2005-167020 A1 6/2005
JP 2011-077254 A1 4/2011

*Primary Examiner* — Kristal Feggins
(74) *Attorney, Agent, or Firm* — Burr & Brown, PLLC

(57) ABSTRACT

According to one embodiment, a thermal print head includes a heat sink, a head substrate having a plurality of heat generating elements placed on the heat sink and disposed in a primary scanning direction, a circuit board placed on the heat sink so as to be adjacent to the head substrate in an auxiliary scanning direction and provided with a connection circuit, and a control element electrically connected to the heat generating element via a first bonding wire and electrically connected to the connection circuit via a second bonding wire, wherein a plurality of first bonding wires is disposed in parallel in the primary scanning direction, and among the first bonding wires, the first bonding wire having a length of at least 2 mm or more is a metal wire having a Young's modulus greater than that of gold.

17 Claims, 11 Drawing Sheets

Cu Wire (23μ mφ )

Au Wire (23μ mφ )

THERMAL PRINT HEAD AND THERMAL PRINTER

CROSS REFERENCE TO RELATED APPLICATION

This application is based upon and claims the benefit of priority from the prior Japanese Patent Applications No. 2017-247710, filed on Dec. 25, 2017, the entire contents of which are incorporated herein by reference.

FIELD OF THE INVENTION

Embodiments described herein relate generally to a thermal print head and a thermal printer.

SUMMARY OF THE INVENTION

The thermal print head (TPH) is an output device that heats a plurality of resistors arrayed in a heat generation region to form an image such as characters and graphics on a thermal recording medium by the heat.

The thermal print head is widely used for recording apparatuses such as bar code printers, digital plate-making machines, video printers, imagers, and seal printers.

The thermal print head includes a heat sink, a head substrate provided on the heat sink, and a circuit board.

A glaze layer is provided on the head substrate, and a plurality of heat generating elements is provided on the glaze layer. A driving IC to control heat generation of the plurality of heat generating elements is mounted on the circuit board.

The plurality of heat generating elements and the driving IC are electrically connected to each other via a bonding wire.

In the thermal print head, as the high resolution is achieved, the number of bonding wires to connect the heat generating element and the driving IC increases. Since the bonding wires are disposed in parallel, the density of the bonding wires inevitably increases.

Therefore, the bonding wires to connect the heat generating elements and the driving ICs are disposed in multiple stages. When the bonding wires are disposed in multiple stages, the length of the bonding wire disposed in the upper stage becomes longer each time the number of stages increases.

Since the bonding wires are more likely to bend as the bonding wires become longer, there is a problem that short-circuit failures occur due to contact between the bonding wires.

DETAILED DESCRIPTION OF THE INVENTION

According to one embodiment, a thermal print head includes a heat sink, a head substrate having a support substrate placed on the heat sink, a glaze layer laminated on the support substrate, and a plurality of heat generating elements provided on the glaze layer and disposed in a primary scanning direction, a circuit board placed on the heat sink so as to be adjacent to the head substrate in an auxiliary scanning direction and provided with a connection circuit, and a control element placed on an upper surface of the head substrate close to the circuit board or on an upper surface of the circuit board close to the head substrate, electrically connected to the heat generating element via a first bonding wire, and electrically connected to the connection circuit via a second bonding wire. A plurality of first bonding wires is disposed in parallel in the primary scanning direction, and among the first bonding wires, the first bonding wire having a length of at least 2 mm or more is a metal wire having a Young's modulus greater than that of gold.

Hereinafter, embodiments of the invention will be described with reference to the drawings.

First Embodiment

Figure 1A:
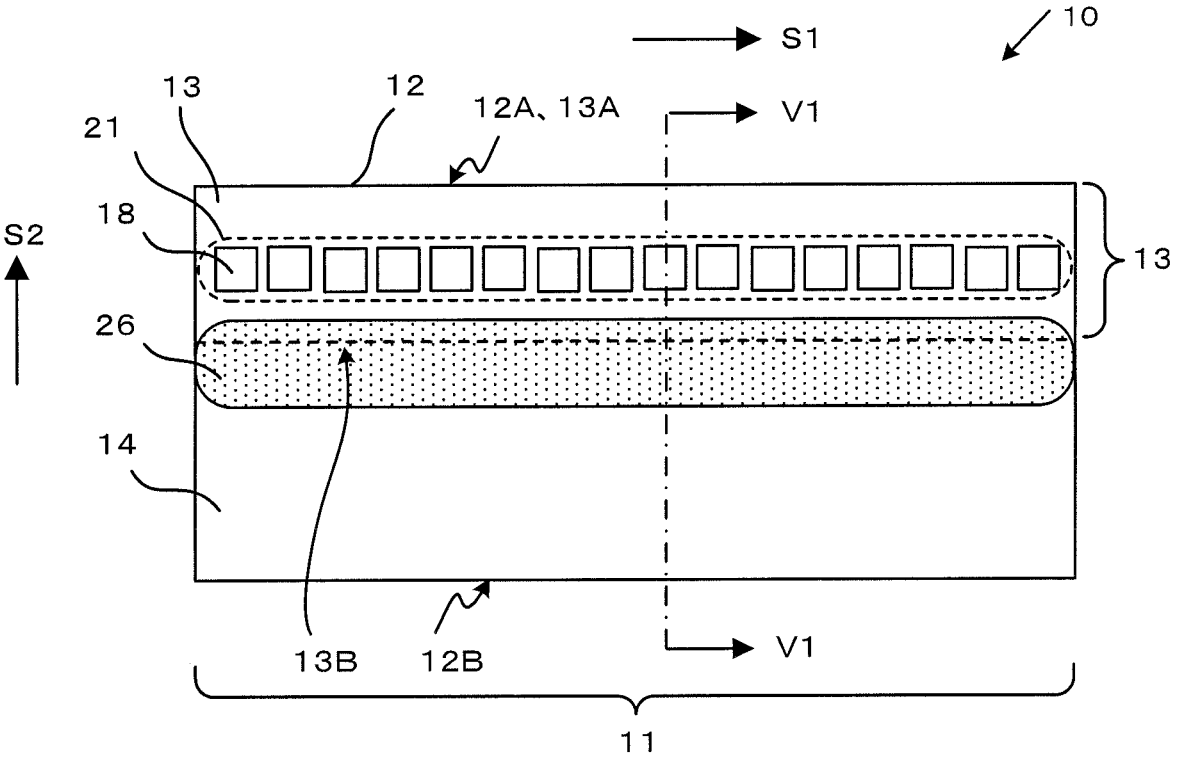
FIGS. 1A and 1B are diagrams illustrating a thermal print head according to a first embodiment.
Figure 1B:
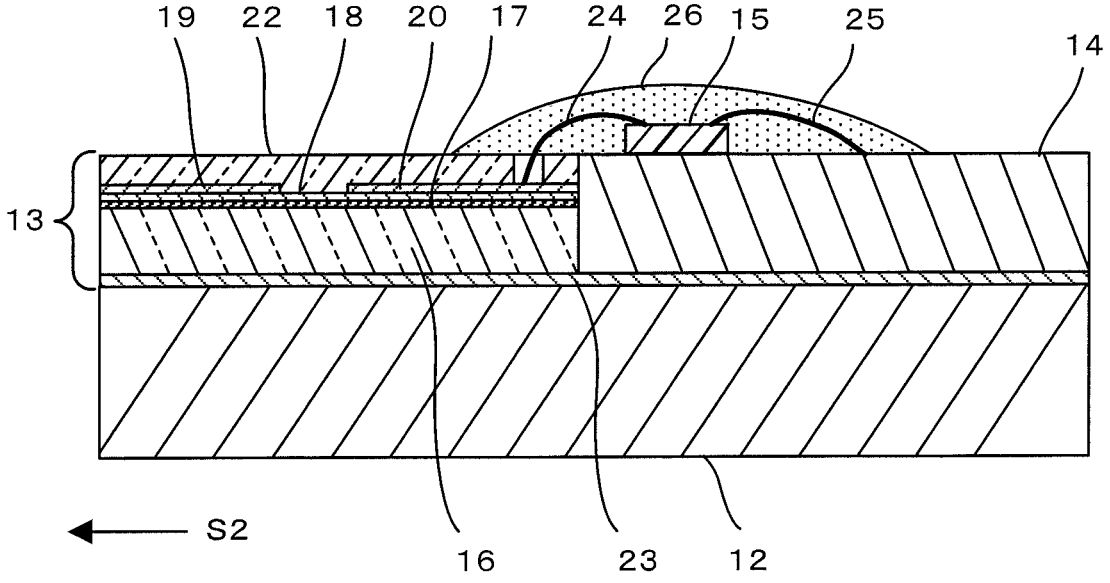
Figures 2A, 2B:
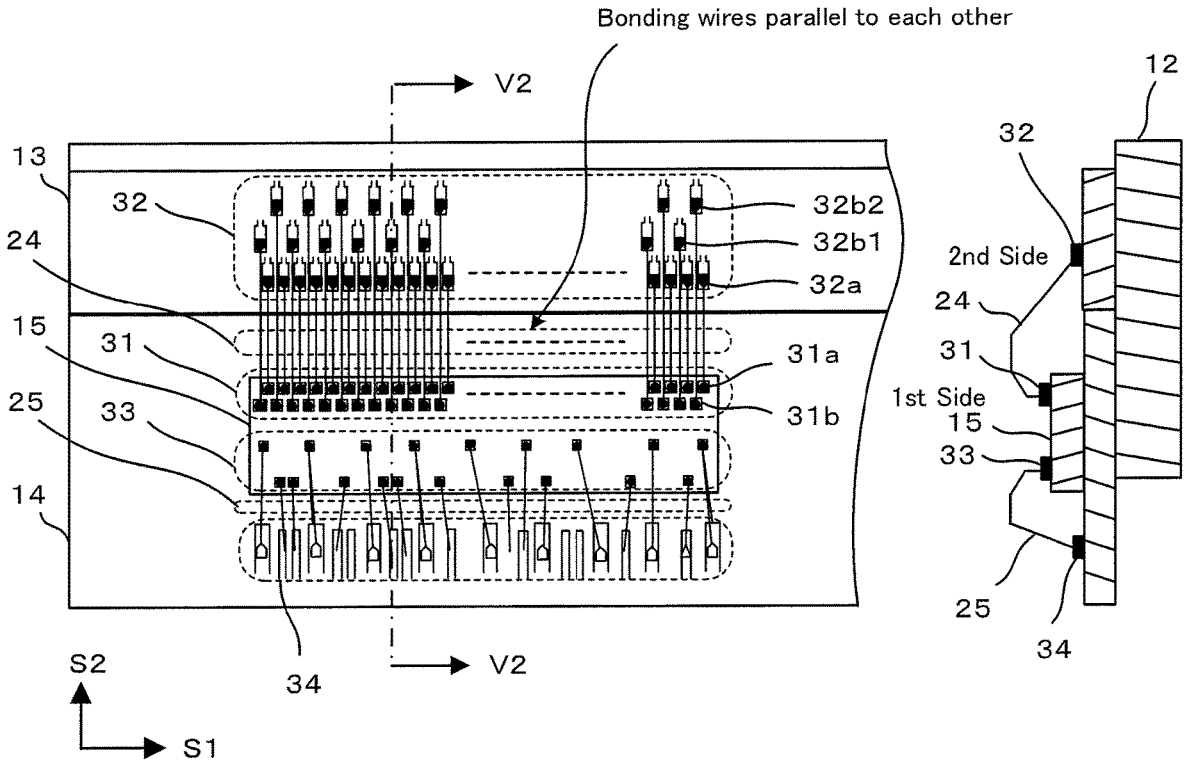
FIGS. 2A and 2B are diagrams illustrating an example of the arrangement of bonding wires of the thermal print head according to the first embodiment.
Figure 3:
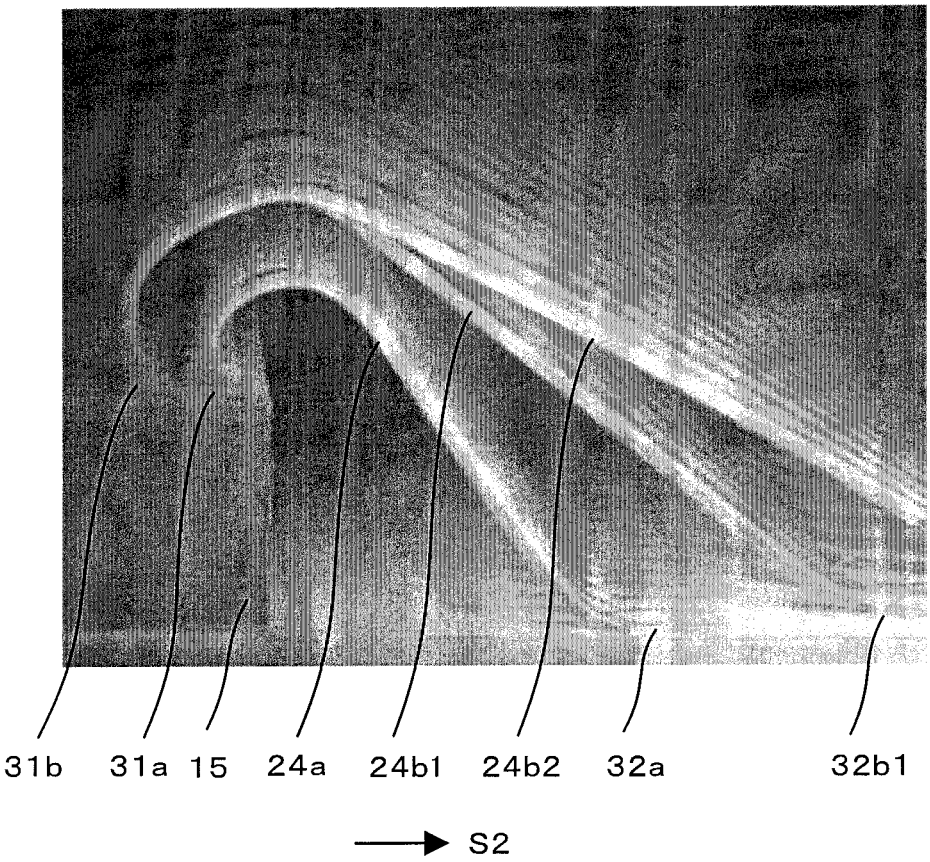
FIG. 3 is a photograph illustrating main parts of an arrangement example of the bonding wires of the thermal print head according to the first embodiment.

A thermal print head according to the embodiment will be described with reference to FIGS. 1 to 3. FIGS. 1A and 1B are diagrams illustrating a thermal print head, FIG. 1A is a plan view of the thermal print head, and FIG. 1B is a cross-sectional view taken along the line V1-V1 of FIG. 1A and viewed in a direction of an arrow. FIGS. 2A and 2B are diagrams illustrating an arrangement example of bonding wires of the thermal print head, FIG. 2A is a plan view of the bonding wires, and FIG. 2B is a cross-sectional view taken along the line V2-V2 of FIG. 2A and viewed in a direction of an arrow. FIG. 3 is a photograph illustrating a main part of the arrangement example of the bonding wires.

The embodiment is merely an example, and the invention is not limited thereto. The drawings are schematic and ratios of each dimension and the like are different from actual ones.

First, the thermal print head will be described.

As illustrated in FIG. 1, the thermal print head 10 has an elongated head unit 11 that is long in a primary scanning direction S1 in which an image can be formed on a recording medium. The head unit 11 has a heat sink 12, a head substrate 13, a circuit board 14, and a plurality of driving ICs 15 (control elements).

The heat sink 12 is made of a metal such as aluminum or stainless steel with good heat dissipation properties. In the heat sink 12, a heat sink one end face 12A in an auxiliary scanning direction S2 orthogonal to the primary scanning direction S1, and a heat sink other end face 12B in a direction opposite to the auxiliary scanning direction S2 (hereinafter also referred to as an auxiliary scanning opposite direction) are substantially parallel, have a substantially uniform thickness, and are formed in a flat plate shape elongated in the primary scanning direction S1.

The other end portion of the heat sink in the auxiliary scanning opposite direction of the heat sink 12 serves as a circuit board placement portion in which the circuit board 14 is disposed, and is formed in a rectangular shape elongated in the primary scanning direction S1. Further, in the heat sink 12, the circuit board 14 and the head substrate 13 are disposed on one surface in order in the auxiliary scanning direction S2.

The head substrate 13 is long in the primary scanning direction S1, and a head substrate one end face 13A in the auxiliary scanning direction S2 and a head substrate other end face 13B in the auxiliary scanning opposite direction are substantially parallel to each other.

The head substrate 13 has a support substrate 16 formed in a rectangular parallelepiped shape by an insulator material having heat resistance, for example, ceramic such as $Al_2O_3$. An external shape of the support substrate 16 is an outer shape of the head substrate 13 as it is. The support substrate 16 may be SiN, SiC, quartz, AlN, or fine ceramics containing Si, Al, O, N, or the like.

On the support substrate 16, a glaze layer 17 made of a glass film such as $SiO_2$ is provided on one surface. The glaze layer 17 can be formed by printing a glass paste prepared by mixing glass powders with an organic solvent and baking the glass paste.

On one surface of the glaze layer 17, a plurality of heat generating resistors 18 elongated in the auxiliary scanning direction S2 is disposed in the primary scanning direction S1 in order at a predetermined inter-substrate resistor arrangement interval. Further, on one surface of the glaze layer 17, a common electrode 19 and an individual electrode 20 are disposed at both end portions of the plurality of heat generating resistors 18 along the auxiliary scanning direction S2, and a heat generating element is formed by the plurality of heat generating resistors 18, the common electrode 19, and the individual electrode 20. As a result, a strip-like portion of the head substrate 13 along the primary scanning direction S1 serves as a heat generating region 21 in which the plurality of heat generating resistors 18 generates heat between the common electrode 19 and the individual electrode 20.

A protective film 22 to cover the plurality of heat generating resistors 18, the common electrode 19, and the individual electrode 20 is formed on one surface of the glaze layer 17.

In FIG. 1A, as the plurality of heat generating resistors disposed on the head substrate 13, an inter-resistor electrode portion forming the heat generating region 21 between the common electrode 19 and the individual electrode 20 is indicated by a solid line. Further, the head substrate 13 adheres to the heat sink 12 via an adhesive 23. The other surface of the support substrate 16 adheres to one surface of the head substrate arrangement portion of the heat sink 12 via the adhesive 23 which is a thermoplastic resin such as a double-sided tape or a silicone resin.

The circuit board 14 is formed as a printed wiring board elongated in the primary scanning direction S1 or is formed by affixing a flexible substrate to a ceramic plate or a glass epoxy resin (one obtained by impregnating an overlapped cloth made of glass fiber with epoxy resin) plate or the like elongated in the primary scanning direction S1. The other surface of the circuit board 14 adheres to one surface of the circuit board arrangement portion of the heat sink 12 via a double-sided tape or an adhesive 23.

A connection circuit (not illustrated) to be electrically connected to the head substrate 13 via a driving IC 15 is formed on the circuit board 14, and a connector (not illustrated) to input drive power and control signals to the connection circuit from the outside is mounted on the circuit board 14.

Each of the plurality of driving ICs 15 is a control element provided with a plurality of first terminals and a plurality of second terminals (not illustrated) on one surface and having a switching function capable of controlling the heat generating elements. The first terminal is an output side terminal, and the second terminal is an input side terminal. The plurality of driving ICs 15 is disposed in order in the primary scanning direction S1, for example, at one end portion in the auxiliary scanning direction S2 of one surface of the circuit board 14 (that is, a boundary portion with the head substrate 13).

In the plurality of driving ICs 15, a plurality of first terminals is electrically connected to the individual electrodes 20 via a plurality of bonding wires 24 (first bonding wires). Further, in the plurality of driving ICs 15, a plurality of second terminals is electrically connected to the corresponding substrate electrodes (not illustrated) formed on the connection circuit of the circuit board 14 via the plurality of bonding wires 25 (the second bonding wires).

The plurality of driving ICs 15 is sealed together with the plurality of bonding wires 24, 25 in the vicinity of a boundary between one surface of the head substrate 13 and one surface of the circuit board 14 by a sealing body 26. The sealing body 26 is a thermosetting resin made of, for example, an epoxy resin, and is formed at a predetermined location through application of an epoxy-based resin coating solution and thermal curing due to heat treatment at approximately 100° C. for several hours.

The sealing body 26 may be made of a silicone-based resin. The silicone-based resin can reduce the resin stress applied to the driving IC 15 compared with the epoxy resin.

In some cases, a required number of the driving ICs 15 may be mounted on the head substrate 13 close to the circuit board 14 along the primary scanning direction S1.

Next, a bonding wire which is a feature of the embodiment will be described. Hereinafter, the bonding wire may be simply referred to as a wire.

As illustrated in FIG. 2, the bonding wire 24 is connected to a bonding pad 31 of a first terminal on an output side of the driving IC 15, and a bonding pad 32 of the corresponding individual electrode 20. The bonding wire 25 is connected to a bonding pad 33 of a second terminal on an input side of the driving IC 15, and a bonding pad 34 of the corresponding substrate electrode provided with the connection circuit of the circuit board 14.

A plurality of bonding pads 31, 32 and bonding wires 24 are provided in accordance with the plurality of heat generating resistors 18. For example, the same number of bonding pads 31, 32 and bonding wires 24 are provided as the plurality of heat generating resistors 18.

In the thermal print head 10, the number of bonding wires 24 increases as the resolution increases, that is, as the number of heat generating resistors 18 per unit length increases. Since the plurality of bonding wires 24 is disposed parallel to each other, the density of the bonding wires 24 increases. In order to dispose the bonding wires 24 in parallel at high density, the bonding wires 24 are disposed in multiple stages.

Incidentally, it goes without saying that the term "parallel" includes a range which does not intersect no matter how long it extends on mathematics and which can achieve a high resolution of the thermal print head and is regarded as substantially parallel.

In order to dispose the bonding wires 24 in multiple stages, the plurality of bonding pads 31, 32 is disposed at a predetermined pitch along the primary scanning direction S1 and disposed in multiple rows along the auxiliary scanning direction S2.

Specifically, the plurality of bonding pads 31 is disposed at a first pitch along the primary scanning direction S1 and disposed in two rows along the auxiliary scanning direction S2. A bonding pad 31*a* is a bonding pad of the first row and a bonding pad 31*b* is a bonding pad of the second row.

The bonding pads 31*a* of the first row and the bonding pads 31*b* of the second row are disposed so as to be shifted from each other by ½ of the first pitch along the primary scanning direction S1 so as not to be aligned on the same straight line along the auxiliary scanning direction S2.

The plurality of bonding pads 32 is disposed along the primary scanning direction S1 and is disposed in three rows along the auxiliary scanning direction S2. A bonding pad 32*a* is a bonding pad of the first row, a bonding pad 32*b*1 is a bonding pad of the second row, and a bonding pad 32*b*2 is a bonding pad of the third row.

The bonding pads 32*a* of the first row are disposed at the same pitch as the first pitch along the primary scanning direction S1. The bonding pads 32*b*1, 32*b*2 of the second and third rows are disposed at a pitch twice the first pitch along the primary scanning direction S1.

The bonding pads 32*a* of the first row, and the bonding pads 32*b*1, 32*b*2 of the second and third rows are disposed so as to be shifted from each other by ½ of the first pitch along the primary scanning direction S1 so as not to be aligned on the same straight line along the auxiliary scanning direction S2. Therefore, the bonding pad 32*b*1 of the second row and the bonding pad 32*b*2 of the third row are disposed so as to be shifted by the first pitch along the primary scanning direction S1.

The bonding pads 31*a* of the first row and the bonding pads 32*a* of the first row are disposed so as to be aligned on substantially the same straight line along the auxiliary scanning direction S2. The bonding pads 31*b* of the second row and the bonding pads 32*b*1, 32*b*2 of the second and third rows are disposed so as to be aligned on substantially the same straight line along the auxiliary scanning direction S2.

Among the adjacent bonding pads 31*b* of the second row, one and the bonding pad 32*b*1 of the second row are disposed so as to be aligned on substantially the same straight line along the auxiliary scanning direction S2, and the other and the bonding pad 32*b*2 of the third row are disposed so as to be aligned on substantially the same straight line along the auxiliary scanning direction S2.

Therefore, as illustrated in FIG. 3, the bonding wires 24 are disposed in two stages. A bonding wire 24*a* connecting the bonding pads 31*a*, 32*a* of the first row is the bonding wire of the first stage. A bonding wire 24*b*1 connecting the bonding pads 31*b* and 32*b* of the second row, and a bonding wire 24*b*2 connecting the bonding pad 31*b* of the second row and the bonding pad 32*c* of the third row are the bonding wires of the second stage.

The bonding wire 24*a* of the first stage is disposed at a first pitch along the primary scanning direction S1. Similarly, the second-stage bonding wires 24*b*1, 24*b*2 are disposed at a first pitch along the primary scanning direction S1.

The bonding wires 24*b*1, 24*b*2 of the second stage also have a height of a loop and a length of the wire larger than those of the bonding wire 24*a* of the first stage. The length of the bonding wire 24*b*2 of the second stage is larger than that of the bonding wire 24*b*1 of the second stage.

However, each of the driving IC, the bonding pad, and the bonding wire illustrated in FIG. 3 is dummy, which is different from the actual one.

Figure 4:
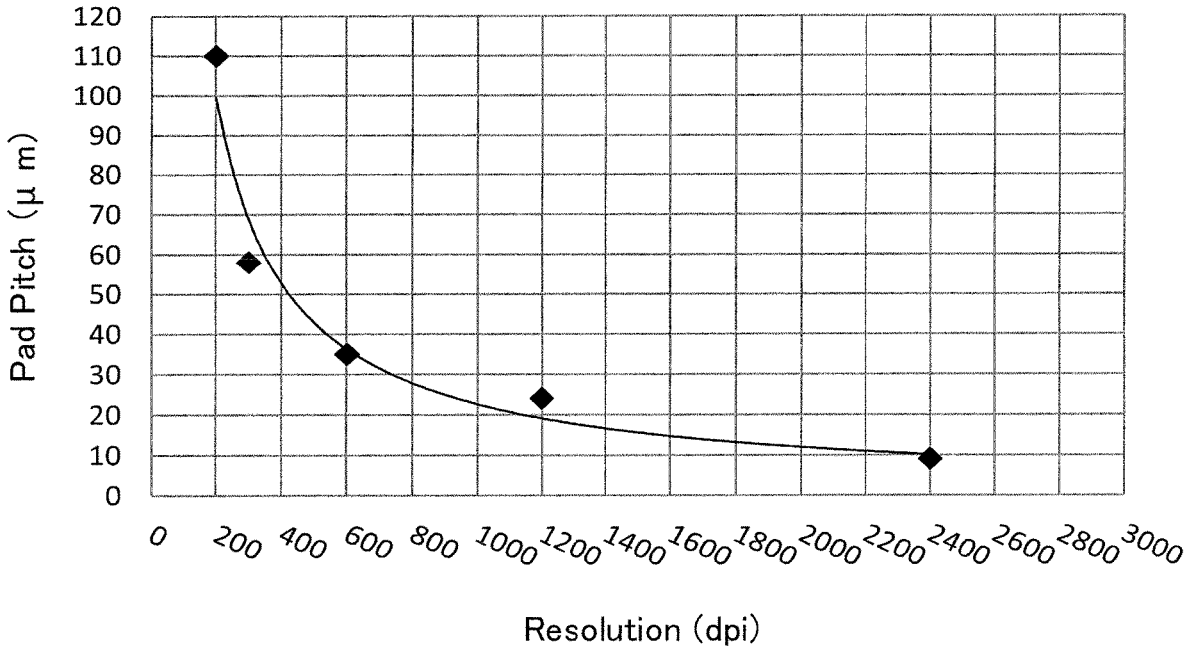
FIG. 4 is a diagram illustrating a relation between the resolution of the thermal print head and a pitch of a bonding pad according to the first embodiment.

FIG. 4 is a diagram illustrating a relation between the resolution of the thermal print head and the pitch of the bonding pad. In the drawing, a symbol ♦ is an example of a design value of a pad pitch necessary to obtain the predetermined resolution, and a solid line is an approximate curve illustrating a relation between the resolution and the pitch of the bonding pad.

As illustrated in FIG. 4, the pad pitch decreases in accordance with the resolution, and is basically in an inversely proportional relation. For example, in order to achieve a resolution of 600 dpi, it is necessary to set the pad pitch to approximately 35 μm. In order to achieve resolutions of 1200 dpi and 2400 dpi, it is necessary to set the pad pitch to approximately 25 μm and approximately 10 μm, respectively.

Figure 5:
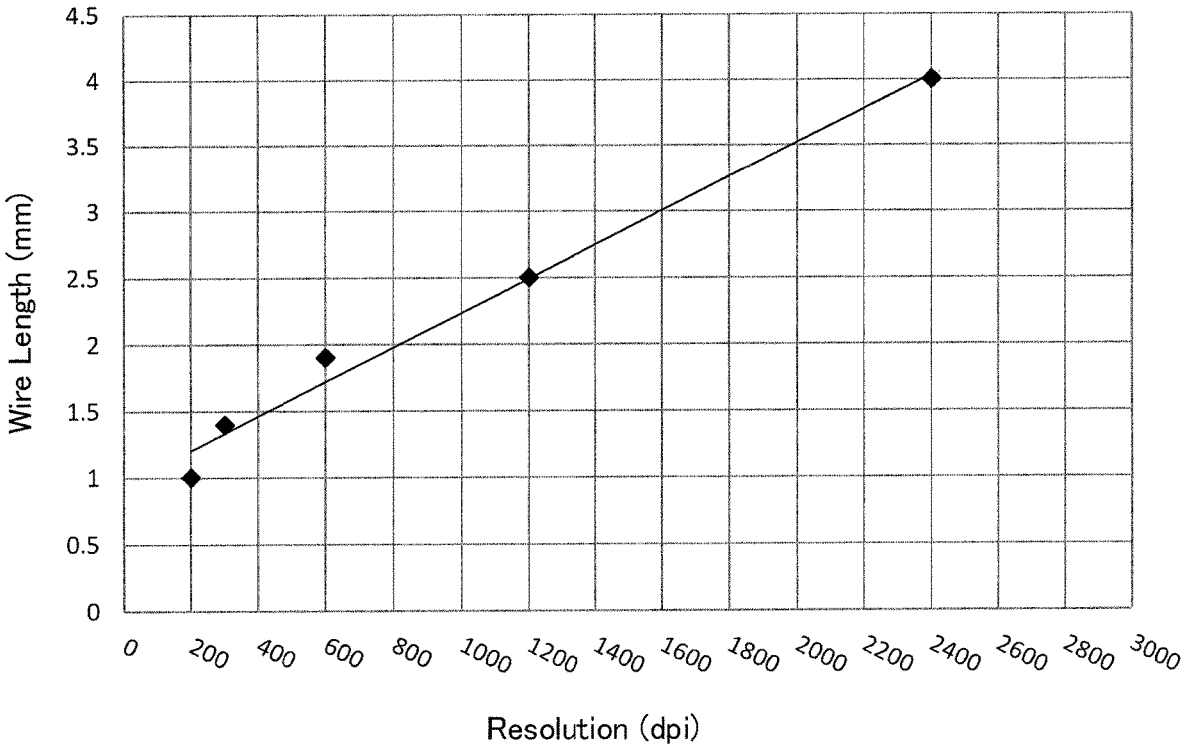
FIG. 5 is a diagram illustrating a relation between the resolution of the thermal print head and the bonding wire length according to the first embodiment.

FIG. 5 is a diagram illustrating a relation between the resolution of the thermal print head and the length of the bonding wire. In the drawing, a symbol ♦ is an example of the design value of the wire length necessary to obtain the predetermined resolution, and a solid line is the approximate curve illustrating a relation between the resolution and the wire length. The wire length is the length of the uppermost bonding wire, and in FIG. 3, the bonding wire 24*b*2 of the second stage is the uppermost bonding wire.

As illustrated in FIG. 5, the wire length becomes longer in accordance with the resolution, and it is in a roughly proportional relation. For example, in order to achieve a resolution of 600 dpi, a wire length of 2 mm is required. In order to achieve resolutions of 1200 dpi and 2400 dpi, the wire lengths of 2.5 mm and 4 mm are required, respectively.

That is, in order to achieve high resolution, since the bonding wires are disposed in multiple stages, the length of the bonding wire disposed in the upper stage becomes longer each time the number of stages increases. Since the bonding wires are more likely to bend as the length increases, there is a problem that short-circuit failures occur due to contact between the bonding wires.

As a result of various investigations in the embodiment, it has been confirmed that short-circuit failure can be prevented even with a wire having a length of 2 mm or more and about 4 mm, when using a metal wire having a Young's modulus larger than that of a gold wire commonly used as a bonding wire. That is, since the metal wire with high rigidity which is larger than the Young's modulus (approximately $80\times10^9$ N/m$^2$) of gold is hard to bend, it is possible to prevent short-circuit failure between the wires.

As a metal wire having a Young's modulus larger than that of a gold wire, a copper (Cu) wire (Young's modulus: approximately $130\times10^9$ N/m$^2$) is suitable. The metal wire may be a copper alloy wire or a metal wire containing copper as a main component, other than a copper wire.

The copper alloy wire is a copper wire in which a trace amount (a percentage or less) of impurities is added to pure copper (for example, purity 4 N, 99.99% or more). Examples of elements capable of being added include calcium (Ca), boron (B), phosphorus (P), aluminum (Al), silver (Ag), selenium (Se), and the like. It is expected that when these elements are added, high elongation characteristics are obtained and the strength of the bonding wire is further improved.

Further, beryllium (Be), tin (Sn), zinc (Zn), zirconium (Zr), silver (Ag), chromium (Cr), iron (Fe), oxygen (O), sulfur (S), hydrogen (H), and the like are exemplified. By containing 0.001 wt % or more of elements other than copper, high elongation characteristics are expected.

The metal wire containing copper as a main component is, for example, a copper wire subjected to palladium (Pd) plating and gold (Au) plating. The plating layers are provided to suppress the oxidation of copper.

The bonding pads 31 to 34 are, for example, metals containing aluminum (Al) as a main component. A metal containing aluminum (Al) as a main component is, for example, an alloy obtained by mixing Al with a several percent of silicon (Si).

Although it is sufficient that the number of bonding wires 25 is smaller than that of bonding wires 24, basically, the bonding wires 25 are disposed in multiple stages similarly to the bonding wires 24. The bonding wire 25 can be set to substantially the same type (same material, and same diameter) as the bonding wire 24.

Next, the bending of the bonding wire will be described with reference to FIGS. 6 to 8 in comparison with the bonding wire of the comparative example. Here, the bonding wire of the comparative example is a gold (Au) wire commonly used as a bonding wire.

Figure 6A:
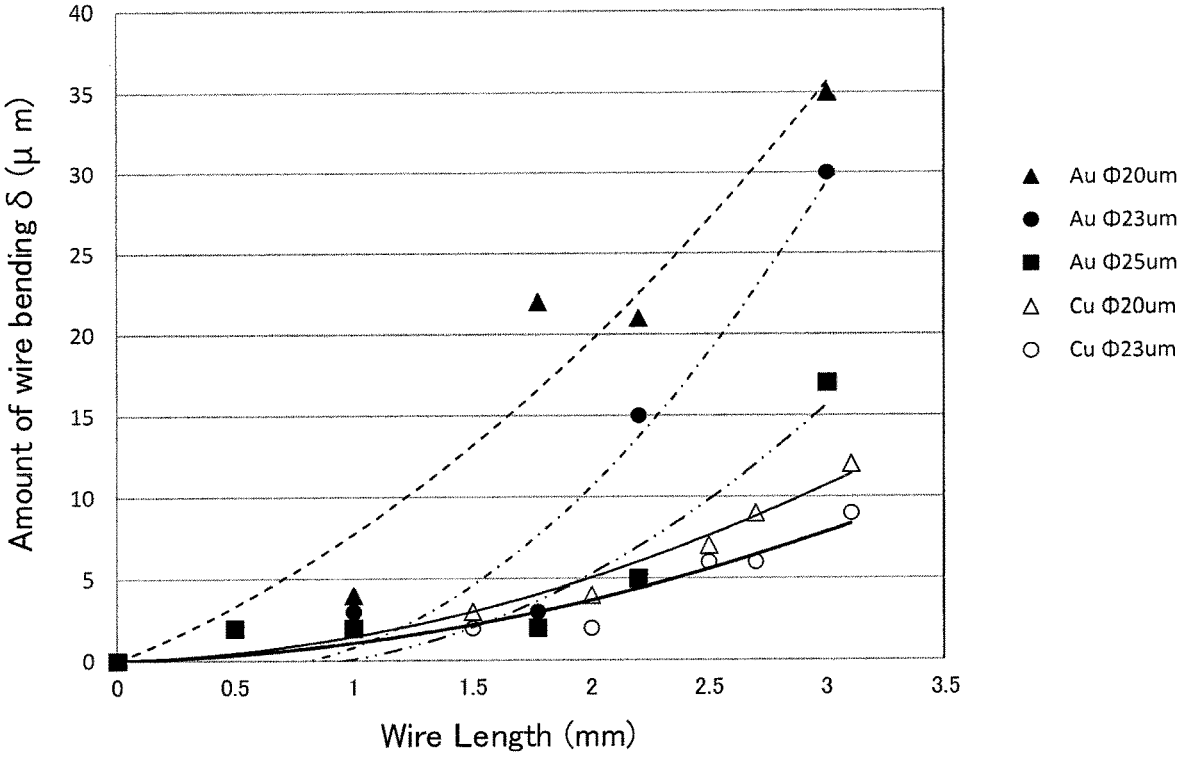
FIGS. 6A and 6B are diagrams illustrating a relation between a length of the bonding wire and a bending amount according to the first embodiment in comparison with a bonding wire of the comparative example.

FIG. 6A is a diagram illustrating a relation between the length of the bonding wire and the amount of wire bending in comparison with the bonding wire of the comparative example, and is a case in which a material (a copper wire, and a gold wire) of the wire and a wire diameter (20 μmϕ, 23 μmϕ, and 25 μmϕ) are set as parameters, and the wire length are varied from 0.5 mm to 3.1 mm.

A symbol Δ represents the result of a 20 μmϕ copper wire, and a thin solid line represents the approximate expression. A symbol ○ represents the result of a 23 μmϕ copper wire, and a thick solid line represents the approximate expression.

A symbol ▲ represents the result of a 20 μmϕ gold wire, and a broken line represents the approximate expression. A symbol ● represents the result of a 23 μmϕ gold wire, and an alternate long and short dashed line represents the approximate expression. A symbol ■ represents the result of a 25 μmϕ gold wire, and a two-dot chain line represents the approximate expression.

Figure 6B:
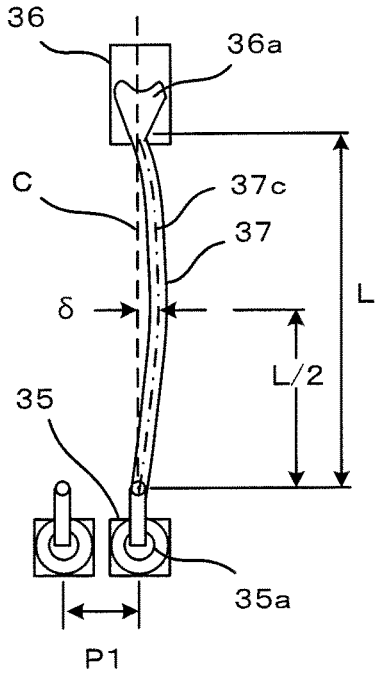

FIG. 6B is a diagram for describing the bending amount of the bonding wire. As illustrated in FIG. 6B, a bending amount δ is an amount of deviation of a portion in which a center line 37*c* of the wire 37 is the farthest from the straight line C connecting a joining portion between a first ball 35*a* side and a second stitch 36*a* side, between the two bonding pads 35, 36. When a length of the straight line C is defined as L, the portion in which the center line 37*c* of the wire 37 is farthest from the straight line C is in the vicinity of L/2.

An arrangement pitch of the bonding pads 35 is defined as P1 and the diameter of the wire 37 is defined as D. When the bending amount of the wire 37 connected to one of the adjacent bonding pads 35 is defined as δ=(P1−D)/2 and the bending amount of the wire 37 connected to the other is defined as δ=−(P1−D)/2, the wires 37 come into contact with each other. Therefore, in order to prevent contact between the adjacent wires 37 in advance, it is necessary to set an allowable value of the bending amount δ to be smaller than (P1−D)/2. Here, the arrangement pitch of the bonding pads 35 is the same as the arrangement pitch of the wires 37.

As illustrated in FIG. 6A, in both the copper wire and gold wire, the wire bending amount δ increases as the wire becomes longer, and the wire bending amount δ increases as the wire becomes thinner. However, it can be seen that the bending amount of the copper wire is obviously small when comparing the copper wire and the gold wire.

Between the wire length of 2 mm and 3.1 mm, the bending amount δ of 23 μmϕ gold wire is approximately 10 μm to 30 μm. On the other hand, the bending amount δ of the 23 μmϕ copper wire is approximately 4 μm to 9 μm. The bending amount of 23 μmϕ copper wire is approximately ⅓ of the 23 μmϕ gold wire.

The bending amount δ of 20 μmϕ gold wire is about 20 μm to 35 μm. On the other hand, the bending amount δ of the 20 μmϕ copper wire is about 5 μm to 12 μm. The bending amount of 20 μmϕ copper wire is about ⅓ of the 20 μmϕ gold wire.

Incidentally, when the wire length is 2 mm or more, a gold wire having a length larger than 25 μmϕ is required to make the bending amount of the gold wire the same as that of the copper wire. When the wire is thickened, since the wire pitch expands by an amount corresponding to thickening of the wire, high resolution cannot be obtained.

Figure 7A:
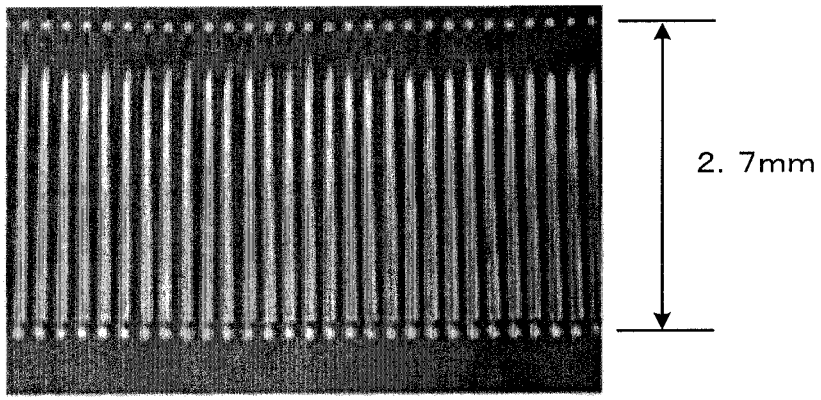
FIGS. 7A and 7B are photographs illustrating a degree of bending of the bonding wire according to the first embodiment in comparison with the bonding wire of the comparative example.
Figure 7B:
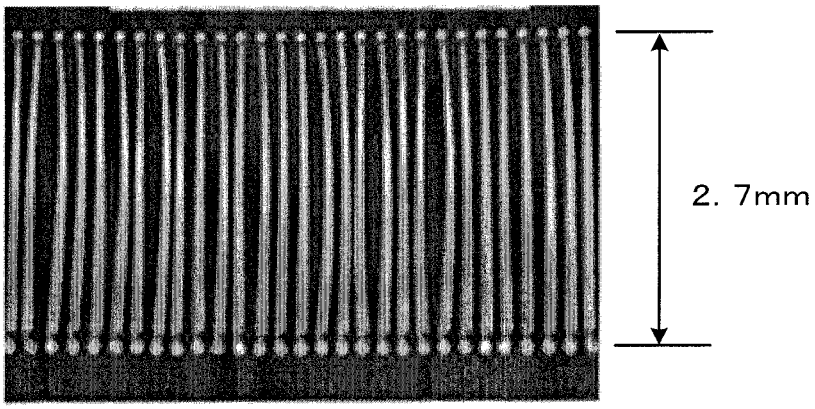

FIGS. 7A and 7B are photographs illustrating an example of the degree of bending of the wire when the length of the bonding wire is 2.7 mm in comparison with the bonding wire of the comparative example. FIG. 7A is a photograph illustrating the degree of bending of the copper wire, and FIG. 7B is a photograph illustrating the degree of bending of the gold wire.

As illustrated in FIGS. 7A and 7B, in the gold wire, the degree of bending is not uniform and many wires which are almost in contact with each other are observed. On the other hand, in the copper wire, the degree of bending is substantially uniform, and wires which are likely to come in contact with each other are not observed.

Figure 8A:
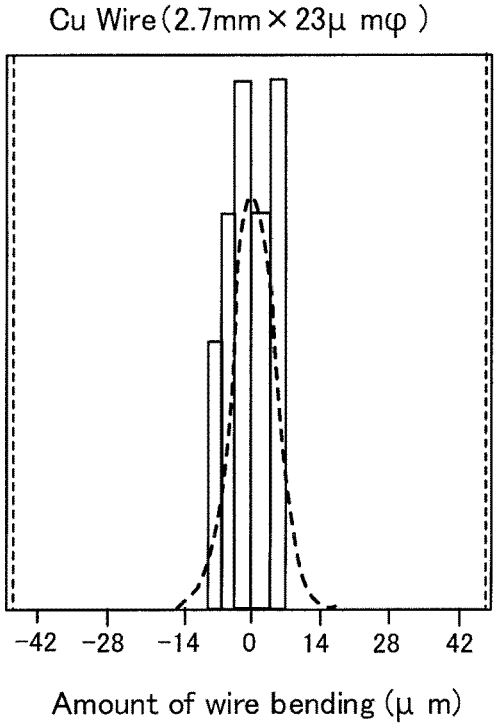
FIGS. 8A and 8B are diagrams illustrating the distribution of the bending amount of the bonding wire according to the first embodiment in comparison with the bonding wire of the comparative example.
Figure 8B:
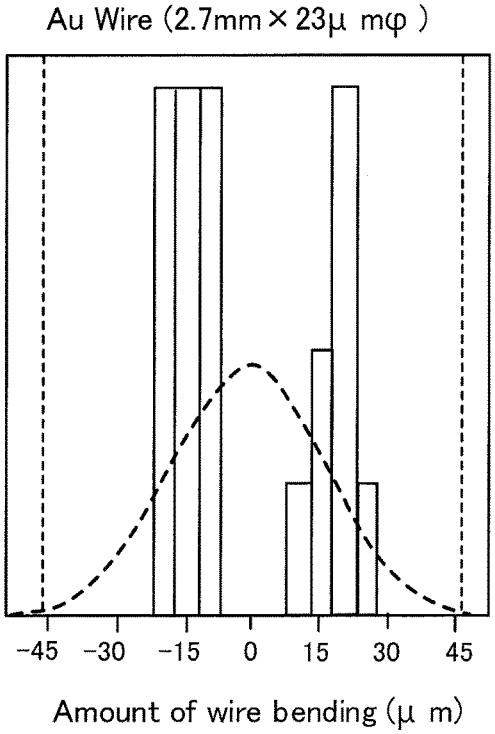

FIGS. 8A and 8B are diagrams illustrating the distribution of the bending amount of the bonding wire illustrated in FIGS. 7A and 7B in comparison with the bonding wire of the comparative example. FIG. 8A illustrates the distribution of the bending amount of the copper wire, and FIG. 8B is a diagram illustrating the distribution of the bending amount of the gold wire. The distribution of the bending amount is indicated by a histogram and a normal curve assuming a normal distribution.

As illustrated in FIGS. 8A and 8B, in the gold wire, the distribution of the bending amount is broad. No gold wire with a bending amount in the vicinity of 0 μm is observed, and the bending amount of the gold wire is concentrated in the vicinity of +20 μm and −15 μm. That is, there is no gold wire which is not bent, and the gold wire is bent in both the + direction and the − direction.

On the other hand, in the copper wire, the distribution of the bending amount is sharp. The bending amount is concentrated in a range narrower than ±10 μm with 0 μm as the center. That is, many copper wires are not bent, and even if the copper wires are bent, the bending is very small.

As described above, the copper wire has a higher Young's modulus than the gold wire and has high rigidity. Thus, even if a long bonding wire of 2 mm or more is used, bending of the wire is very small. That is, even if the bonding wire becomes long, the copper wire is more excellent in linearity than the gold wire.

Accordingly, in a high-resolution thermal print head, it is possible to prevent short-circuit failure between bonding wires, using a copper wire which is a metal wire having a Young's modulus higher than that of gold as a bonding wire disposed in parallel. When the copper wire is used, a thermal print head having a resolution three times higher than that of the gold wire may be obtained.

A relation between the resolution of the thermal print head and the allowable amount of wire bending will be described with reference to FIGS. 4 to 6.

(1) When the Resolution of the Thermal Print Head is 600 dpi

From FIG. 4, the pad pitch is 35 μm, and from FIG. 5, the wire length is 1.7 mm. When a metal wire having a diameter D of 23 μmϕ is used, the allowable value of the wire bending amount is (35−23)/2=6 μm. Here, the arrangement of the wires is one stage.

From FIGS. 6A and 6B, when the wire length is 1.7 mm, the bending amount δ of the 23 μmϕ gold wire is estimated to be about 7 μm from the approximate expression. However, a value of about 3 μm is obtained in the test, and a margin is small with respect to the allowable value defined in the specification, but a resolution of 600 dpi can be achieved. On the other hand, the bending amount δ of 23 μmϕ copper wire is 3 μm for both approximate value and test value, and the allowable value is sufficiently satisfied. Therefore, even in the gold wire, a resolution of 600 dpi can be achieved, but a copper wire can achieve a resolution of 600 dpi with a larger margin.

Although the arrangement of the wires is one stage, the wires may be disposed in two stages. By arranging the wires in two stages, a resolution of 600 dpi can be achieved with a more sufficient margin.

(2) When the Resolution of the Thermal Print Head is 1200 dpi

From FIG. 4, the pad pitch is 25 μm, and from FIG. 5, the wire length is 2.5 mm. When a metal wire having a diameter D of 23 μmϕ is used, the allowable value of the wire bending amount is (25−23)/2=1 μm.

From FIGS. 6A and 6B, when the wire length is 2.5 mm, since both the 23 μmϕ gold wire and the 23 μmϕ copper wire do not satisfy the allowable values, the wires are disposed in multiple stages. For example, the wires are disposed in two stages on the basis of the arrangement of the pads illustrated in FIG. 2. As a result, the allowable value of the bending amount of the wire is (25×2−23)/2=13.5 μm between the adjacent wires of the second stage.

From FIGS. 6A and 6B, when the wire length is 2.5 mm, the bending amount δ of the 23 μmϕ gold wire is 20 μmϕ from the approximate expression and does not satisfy the allowable value. On the other hand, the bending amount δ of the 23 μmϕ copper wire is 6 μm for both the approximate value and the test value, and satisfies the allowable value. Therefore, it is difficult to achieve a resolution of 1200 dpi with a gold wire, but a resolution of 1200 dpi can be achieved with a copper wire.

When the resolution of the thermal print head is 2400 dpi, the pad pitch is 10 μm from FIG. 4, and the wire length is 4 mm from FIG. 5. Even if a metal wire having a diameter D of 20 μmϕ is used, since the pad pitch is smaller than the wire diameter, it is necessary to further arrange the wires in multiple stages.

In the copper wire, since the wire tip is easier to bend and the deposit easily occurs as compared to the gold wire, bonding conditions are more difficult than the gold wire. To cope with the problem, it is preferable to use, for example, the wire bonding method illustrated in FIG. 9.

Figure 9:
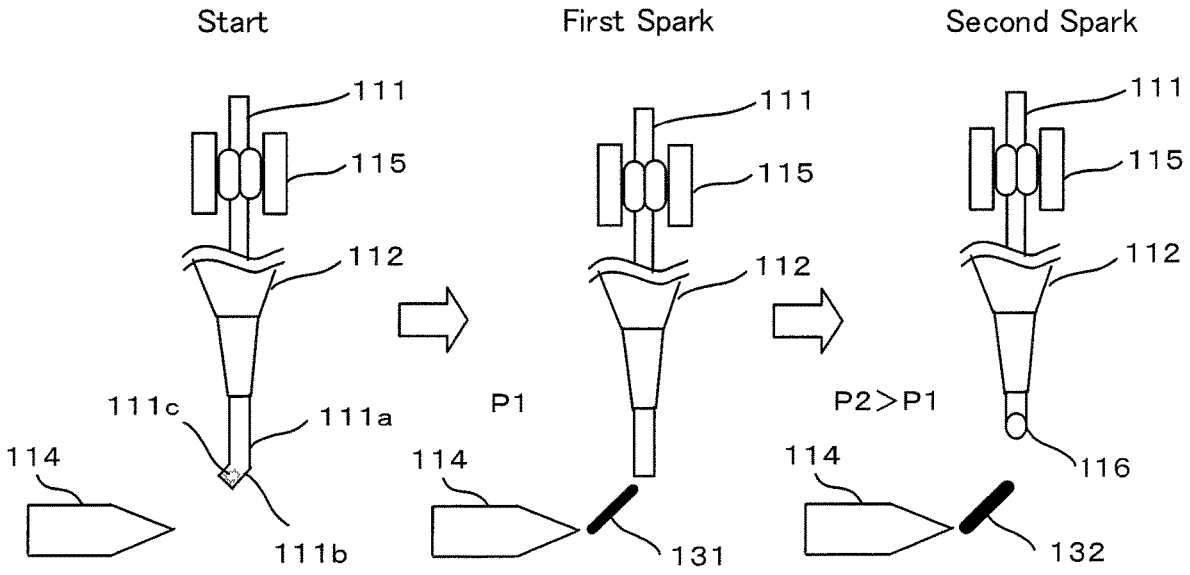
FIG. 9 illustrates an example of a wire bonding method according to the first embodiment.

In the wire bonding method illustrated in FIG. 9, a first spark having a first energy is applied to a tail tip of a wire and then an initial ball is formed at a second step of applying a second spark having a second energy greater than the first energy.

As illustrated in FIG. 9, a wire 111 is inserted into a capillary 112. A first spark 131 having a first energy P1 is applied to the tip of the wire 111 inserted into the capillary 112 by an electric torch 114. As a result, a bent 111*b* of the tail 111*a* and a deposit 111*c* such as dissimilar metals are melted and removed, and the tail 111*a* is adjusted to an initial state.

A second spark 132 having a second energy P2 greater than the first energy P1 is applied to the tail 111*a* by the electric torch 114. As a result, the tail 111*a* adjusted to the initial state is melted, the melted tail 111*a* is rounded by surface tension, and a clean spherical initial ball 116 (Free Air Ball: FAB) is formed.

Thereafter, respective processes, such as a first bonding formation on the bonding pad 31 of the driving IC 15→a loop formation→a second bonding formation on the bonding pad 32→a stitch formation→a capillary ascent→a tail cutting, are performed as well as the ordinary wire bonding method.

Since the shape and size of the initial ball 116 are constant only by setting the first and second energy to preferable values in advance, the method of forming the initial ball in the copper wire in two steps enables the stable bonding of the copper wire.

As described above, in the thermal print head 10 of the embodiment, copper wires are used for the bonding wires 24, 25 as metal wires having a Young's modulus higher than that of gold. As a result, since the copper wire has higher rigidity than the gold wire, even if the bonding wire is long, the bending amount of the wire is small and straightness is excellent.

Therefore, it is possible to prevent short-circuit failure between the bonding wires and obtain a high-resolution thermal print head.

In the embodiment, a case where a copper wire is used as the bonding wires 24, 25 has been described, but the same effect can be obtained by either the copper alloy wire or the metal wire containing copper as a main component.

As a metal wire having a Young's modulus greater than that of gold, the metal wire is not limited to any of a copper wire, a copper alloy wire, and a metal wire containing copper as a main component, and other metal wires are also applicable. However, from the viewpoints of material cost, versatility and the like, it is more suitable to use any of a copper wire, a copper alloy wire, or a metal wire containing copper as a main component as the metal wire.

Since the length of the bonding wire 25 does not directly correspond to the resolution of the thermal print head, the bonding wires 24, 25 do not necessarily need to be the wires of the same material and the same wire diameter.

Further, depending on the length of the bonding wire 24 and the like, all the bonding wires 24 do not necessarily need to be the copper wires. However, when wires of different materials and different wire diameters are mixed, since the manufacturing process is complicated, it is needless to say that the bonding wires 24, 25 are desirably made of wire of substantially the same type (material and wire diameter).

Although a case where the bonding wires are disposed in two stages has been described, the number of stages may be appropriately selected in accordance with the resolution of the thermal print head. The arrangement of the bonding pads is not limited to the example of FIG. 3, and may be appropriately selected within a range that satisfies the allowable value of the wire bending.

Although a case in which the driving IC 15 is placed on the upper surface of the circuit board 14 close to the head substrate 13 has been described, the driving IC 15 may be placed on the upper surface of the head substrate close to the circuit board.

Figure 10A:
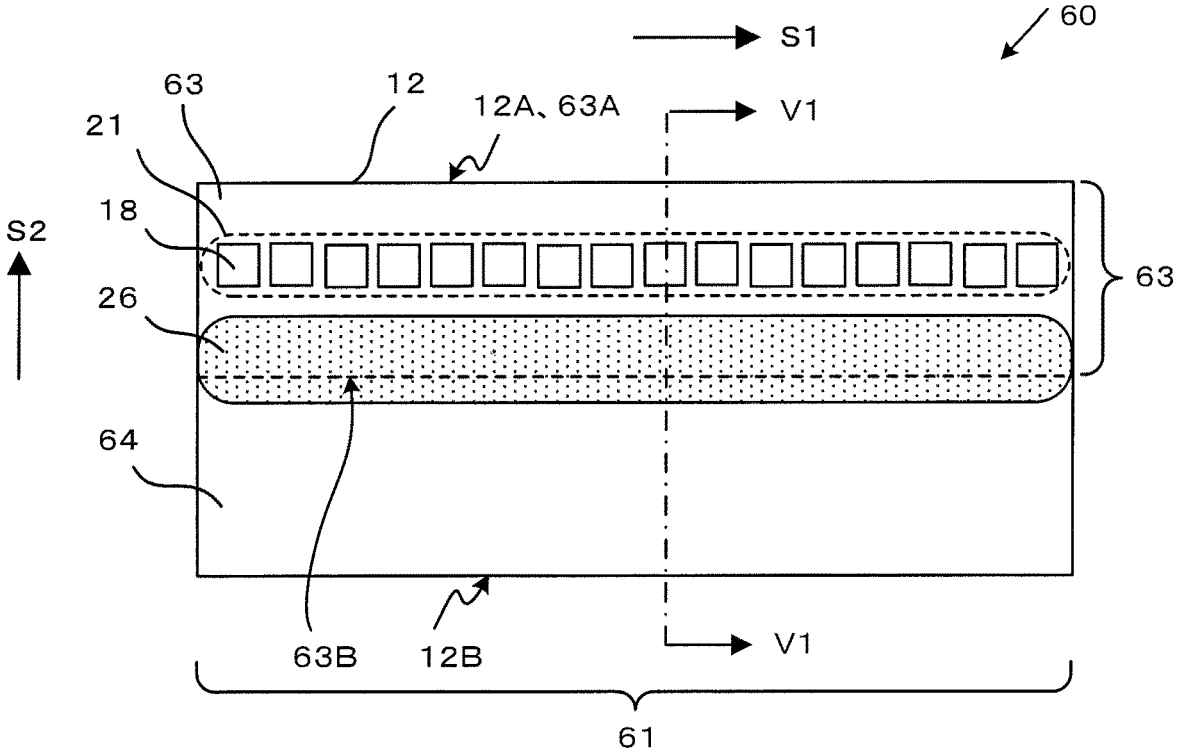
FIGS. 10A and 10B are diagrams illustrating another thermal print head according to the first embodiment.
Figure 10B:
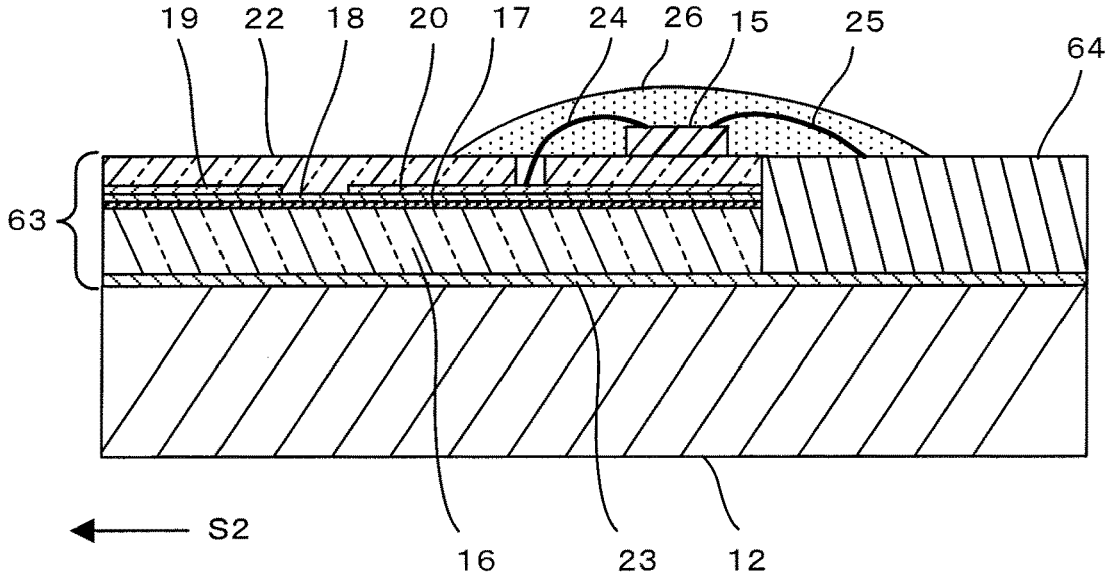

FIGS. 10A and 10B are diagrams illustrating another thermal print head, FIG. 10A is a plan view of another thermal print head, and FIG. 10B is a cross-sectional view taken along the line V1-V1 of FIG. 10A and viewed in the direction of the arrow. The same constituent portions as those of the thermal print head 10 are denoted by the same reference numerals, the description of the same constituent portions will be omitted, and only the different portions will be described.

As illustrated in FIGS. 10A and 10B, in another thermal print head 60, the driving IC 15 is placed on the upper surface of the head substrate 63 close to the circuit board 64.

The head unit 61 has a head substrate 63 having a length in the auxiliary scanning direction S2 longer than that of the head substrate 13 illustrated in FIG. 1, and a circuit board 64 having a length in the auxiliary scanning direction S2 shorter than that of the circuit board 14 illustrated in FIG. 1. The length of the head unit 61 in the auxiliary scanning direction S2 is substantially the same as the length of the head unit 11 in the auxiliary scanning direction S2 illustrated in FIG. 1.

The plurality of driving ICs 15 is disposed, for example, at one end portion in the auxiliary scanning direction S2 on one surface of the head substrate 63 (that is, a boundary portion with the circuit board 64) in order in the primary scanning direction S1.

In the plurality of driving ICs 15, the plurality of first terminals is electrically connected to the corresponding individual electrodes 20 of the head substrate 63 via the plurality of bonding wires 24 respectively. Further, in the plurality of driving ICs 15, the plurality of second terminals is electrically connected to the corresponding substrate electrodes (not illustrated) formed in the connection circuit of the circuit board 64 via the plurality of bonding wires 25 respectively.

The plurality of driving ICs 15 and the plurality of bonding wires 24, 25 are sealed by the sealing body 26 in the vicinity of the boundary between one surface of the head substrate 63 and one surface of the circuit board 64.

Second Embodiment

Figure 11:
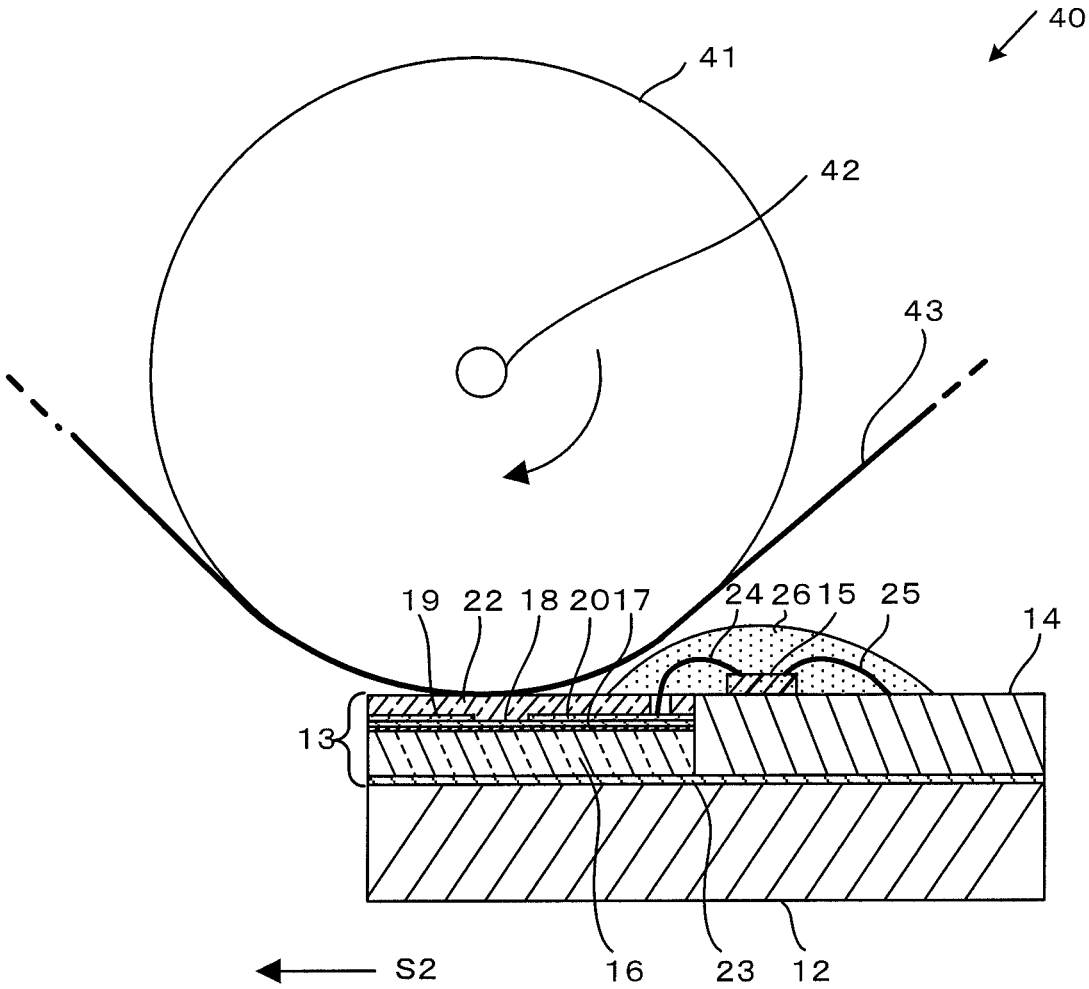
FIG. 11 is a cross-sectional view illustrating a thermal printer using a thermal print head according to a second embodiment.

A thermal printer according to the embodiment will be described with reference to FIG. 11. FIG. 11 is a cross-sectional view illustrating a thermal printer using the thermal print head 10.

As illustrated in FIG. 11, the thermal printer 40 includes a platen roller 41. The platen roller 41 is disposed such that a side surface comes into contact with a heat generation region (a belt-like region in which a plurality of heat generating resistors 18 is disposed) 21 with the primary scanning direction S1 as an axis, and is provided to be rotatable about the shaft 42.

The thermal printer 40 moves a thermal sheet 43 (an image-receiving sheet) inserted between the platen roller 41 and the heat generating region 21 in the auxiliary scanning direction S2 perpendicular to the primary scanning direction S1, by the rotation of the platen roller 41. Along with the movement of the thermal sheet 43, the plurality of heat generating resistors 18 is selectively heated to forma desired image.

At the time of printing, the platen roller 41 presses the thermal sheet 43 against the heat generating resistor 18. By rotating the platen roller 41 in the auxiliary scanning direction S2, printing on the thermal sheet 43 is performed by heat generated from the heat generating element.

As described above, since the thermal printer 40 of the embodiment uses the thermal print head 10, a high-resolution thermal print head can be obtained.

In the embodiment, a case where the image-receiving sheet is the thermal sheet has been described, but a plain sheet may be used as the image-receiving sheet. In that case, an ink ribbon is placed between the image-receiving sheet and the head substrate 13.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the invention. Moreover, above-mentioned embodiments can be combined mutually and can be carried out.

What is claimed is:

1. A thermal print head comprising:

a heat sink;

a head substrate having a support substrate placed on the heat sink, a glaze layer laminated on the support substrate, and a plurality of heat generating elements provided on the glaze layer and disposed in a primary scanning direction;

a circuit board placed on the heat sink so as to be adjacent to the head substrate in an auxiliary scanning direction and provided with a connection circuit; and a control element placed on an upper surface of the head substrate close to the circuit board or on an upper surface of the circuit board close to the head substrate, electrically connected to the heat generating element via a plurality of first bonding wires, and electrically connected to the connection circuit via a plurality of second bonding wires, wherein the plurality of first bonding wires is disposed in parallel in the primary scanning direction, and among the plurality of first bonding wires, each first bonding wire has a length of at least 2 mm or more and is a metal wire having a Young's modulus greater than that of gold.

2. The thermal print head according to claim 1, wherein a Young's modulus of the metal wire is greater than $80\times10^9$ $N/m^2$.

3. The thermal print head according to claim 2, wherein the metal wire is one of a copper wire, a copper alloy wire, and a wire mainly made of copper and coated with a metal different from copper.

4. The thermal print head according to claim 3, wherein the plurality of first and second bonding wires are substantially the same kind of wire.

5. The thermal print head according to claim 2, wherein the plurality of first and second bonding wires are substantially the same kind of wire.

6. The thermal print head according to claim 1, wherein the metal wire is one of a copper wire, a copper alloy wire, and a wire mainly made of copper and coated with a metal different from copper.

7. The thermal print head according to claim 6, wherein the plurality of first and second bonding wires are substantially the same kind of wire.

8. The thermal print head according to claim 1, wherein an arrangement pitch of the plurality of first bonding wires is 60 μm or less.

9. The thermal print head according to claim 8, wherein a diameter of each first bonding wire is 18 μm or more and 23 μm or less.

10. The thermal print head according to claim 1, wherein a diameter of each first bonding wire is 18 μm or more and 23 μm or less.

11. The thermal print head according to claim 1, wherein the plurality of first and second bonding wires are substantially the same kind of wire.

12. A thermal printer comprising:

a thermal print head; and a platen roller to hold an image-receiving sheet between a plurality of heat generating elements and the platen roller and to move the image-receiving sheet in an auxiliary scanning direction;

wherein the thermal print head comprises:

a heat sink;

a head substrate having a support substrate placed on the heat sink, a glaze layer laminated on the support substrate, and the plurality of heat generating elements provided on the glaze layer and disposed in a primary scanning direction;

a circuit board placed on the heat sink so as to be adjacent to the head substrate in an auxiliary scanning direction and provided with a connection circuit; and a control element placed on an upper surface of the head substrate close to the circuit board or on an upper surface of the circuit board close to the head substrate, electrically connected to the heat generating element via a plurality of first bonding wires, and electrically connected to the connection circuit via a plurality of second bonding wires, wherein the plurality of first bonding wires is disposed in parallel in the primary scanning direction, and among the plurality of first bonding wires, each first bonding wire has a length of at least 2 mm or more and is a metal wire having a Young's modulus greater than that of gold.

13. The thermal printer according to claim 12, wherein a Young's modulus of the metal wire is greater than $80\times10^9$ $N/m^2$.

14. The thermal printer according to claim 12, wherein the metal wire is one of a copper wire, a copper alloy wire, and a wire mainly made of copper and coated with a metal different from copper.

15. The thermal printer according to claim 12, wherein an arrangement pitch of the plurality of first bonding wires is 60 μm or less.

16. The thermal printer according to claim 12, wherein a diameter of each first bonding wire is 18 μm or more and 23 μm or less.

17. The thermal printer according to claim 12, wherein the plurality of first and second bonding wires are substantially the same kind of wire.

* * * * *